US007379663B2

(12) United States Patent
Vincent

(10) Patent No.: US 7,379,663 B2
(45) Date of Patent: May 27, 2008

(54) CONTINUOUS CASTING INSTALLATION AND PROCESS

(75) Inventor: Mark Vincent, Leighton Buzzard (GB)

(73) Assignee: Pyrotek Engineering Materials Limited, Wymbush, Milton Keynes (GB)

( * ) Notice: Subject to any disclaimer, the term of this patent is extended or adjusted under 35 U.S.C. 154(b) by 194 days.

(21) Appl. No.: 10/549,947

(22) PCT Filed: Mar. 18, 2004

(86) PCT No.: PCT/GB2004/001164

§ 371 (c)(1),
(2), (4) Date: Dec. 9, 2005

(87) PCT Pub. No.: WO2004/082867

PCT Pub. Date: Sep. 30, 2004

(65) Prior Publication Data

US 2006/0193367 A1 Aug. 31, 2006

(30) Foreign Application Priority Data

Mar. 21, 2003 (GB) ..... 0306526.5

(51) Int. Cl.
*F24H 1/10* (2006.01)

(52) U.S. Cl. ..... 392/465; 432/250

(58) Field of Classification Search ..... None
See application file for complete search history.

(56) References Cited

U.S. PATENT DOCUMENTS

| | | | | |
|---|---|---|---|---|
| 2,215,587 A | | 9/1940 | Kerschbaum | |
| 2,271,838 A | | 2/1942 | Hanawalt et al. | |
| 2,589,301 A | * | 3/1952 | Smith | 373/110 |
| 3,851,090 A | | 11/1974 | Folgero et al. | |
| 4,135,053 A | | 1/1979 | Kastilahn et al. | |
| 4,347,431 A | | 8/1982 | Pearce et al. | |
| 4,469,162 A | | 9/1984 | Hanas et al. | |
| 4,668,288 A | | 5/1987 | Ouchi et al. | |
| 5,084,089 A | | 1/1992 | Zekely et al. | |

FOREIGN PATENT DOCUMENTS

| | | |
|---|---|---|
| DE | 197 52 548 | 6/1999 |
| EP | 1 258 303 | 7/2003 |
| FR | 2 364 719 | 4/1978 |
| GB | 2 258 592 | 2/1993 |
| JP | 59223148 | 12/1984 |
| JP | 60015054 | 1/1985 |
| JP | 61150757 | 7/1988 |
| WO | WO 97/16051 | 5/1997 |

OTHER PUBLICATIONS

International Search Report dated Mar. 28, 1997.
Great Britain Search Report dated Aug. 26, 2003.

* cited by examiner

*Primary Examiner*—Thor S. Campbell
(74) *Attorney, Agent, or Firm*—Knobbe Martens Olson & Bear LLP

(57) ABSTRACT

A continuous casting installation includes a furnace (2) for heating metal to a first liquid metal temperature, a degassing unit (4), a filter (6), a heating unit (8) and a casting machine (10). The casting machine (10) includes a pair of casting rollers and a nozzle arranged to deliver liquid metal into a nip between the casting rollers, such that the metal solidifies as it passes through the nip. The heating unit (8) is located between the furnace and the casting machine, and is thermostatically controlled to heat the liquid metal to a second liquid metal temperature.

37 Claims, 7 Drawing Sheets

CONTINUOUS CASTING INSTALLATION AND PROCESS

The present invention relates to a continuous casting installation and a continuous casting process, in particular but not exclusively for the continuous casting of aluminium. The invention also relates to a heating unit for use in a continuous casting installation.

DESCRIPTION OF THE RELATED ART

In a continuous casting process (sometimes known as the "twin roll" process), liquid aluminium is fed continuously from a furnace to a casting machine, where it is cast directly into semi-finished form, either as a sheet or a rod. Typically, the casting machine includes a pair of casting rollers and a nozzle that feeds liquid metal into the nip between the rollers. The aluminium freezes as it passes between the rollers and is simultaneously hot-rolled, emerging as a continuous sheet or rod, which is wound onto a reel. By supplying liquid aluminium alternately from two or more furnaces, it is possible to cast continuously for a period of typically 10-15 days.

A continuous casting installation usually includes a number of treatment units between the furnace and the casting machine, for treating the liquid aluminium before it is cast. These may include for example a degassing unit and a filter for removing impurities from the aluminium. The aluminium then flows into a head box, which supplies the liquid metal to the nozzle of the casting machine.

In order to obtain a high quality metal product with a uniform grain structure, it is important that the temperature of the liquid metal at the nozzle of the casting machine is stable. For example, the desired temperature at the nozzle might typically be 700° C. plus or minus 1° C. However, in practice, the temperature of the liquid metal may vary by 5-10° C. from the desired temperature, owing to variations in the temperature of the metal in the furnace and heat losses between the furnace and the casting machine. This can cause an inconsistent grain structure and variations in the mechanical properties of the cast aluminium.

A further problem arises from the fact that in a continuous casting process, the aluminium flows relatively slowly and therefore cools considerably before it reaches the casting machine. Typically, the temperature may fall by 100° C. or more and therefore, in order to provide a casting temperature of 700° C., it may be necessary to heat the furnace to over 800° C. This is disadvantageous since at temperatures above about 750° C., the aluminium tends to absorb large quantities of hydrogen, which must then be removed by degassing before the metal is cast.

DE 197 52 548 relates to a continuous casting process for steel, in which the liquid metal flows through a melt distributor and is heated using an inductive heater, according to the output of a temperature sensor mounted near the outlet. An alternative process using a plasma heating device is also disclosed.

U.S. Pat. No. 5,084,089 relates to a method for in-line inductive heating of non-ferrous metal in a continuous casting operation, using inductive heaters and thermostatic controllers. The method may also include cooling the liquid metal by inserting a solid metal bar or using a water cooling coil. A porous filter may be provided.

WO 97/16051 relates to an electrical heating element for use in metallurgy. The element is encased in a temperature resistant material and mounted in a ladle.

SUMMARY OF THE INVENTION

According to the present invention there is provided a heating unit for use in a continuous casting installation, said heating unit including a heating chamber for liquid metal having an inlet and an outlet, the heating chamber being constructed and arranged for a continuous flow of liquid metal through the chamber from the inlet to the outlet, and at least one thermostatically controllable electrical resistance heating element mounted within the heating chamber below the level of the outlet, said heating element being constructed and arranged to heat liquid metal flowing through the chamber to a predetermined liquid metal temperature.

The heating unit can be used to control the temperature of the liquid metal in the casting machine, by raising it to a predetermined liquid metal temperature before the metal enters the casting machine. In this way, compensation can be provided for fluctuations in the temperature of the liquid metal leaving the furnace and for heat losses during the casting process, thereby ensuring a uniform casting temperature and improving the quality and homogeneity of the cast metal. Further, because the temperature of the metal can be increased downstream of the furnace, it is possible to run the furnace at a lower temperature, so reducing the absorption of gases by the metal. This also helps to improve the quality of the cast metal and/or reduces the degassing requirement. The energy needed to heat the metal in the furnace is also reduced.

The heating element is mounted within the heating chamber, below the level of the outlet, so that at the end of a casting run it remains submerged in metal retained within the casting chamber. This prevents oxides forming on the heating element.

Advantageously, the heating chamber is elongate, and the inlet and the outlet are located towards opposite ends thereof, so that the liquid metal has to travel the full length of the chamber. Preferably, the heating element is elongate and is mounted lengthways within the heating chamber. This ensures a relatively long residency time within the chamber, allowing the temperature of the metal to be raised significantly.

The heating unfit may include at least one temperature sensor, preferably arranged to sense the temperature of liquid metal adjacent the outlet. A further sensor may be provided to sense the temperature of the metal adjacent the inlet.

The heating unit may have a refractory liner, a lid for the heating chamber, and/or a drain outlet for the heating chamber.

Advantageously, the heating unit includes a filter chamber and a transfer conduit connecting the filter chamber and the heating chamber. The use of a combined filter and heating unit simplifies the casting installation. The filter chamber is preferably located upstream of the heating chamber. A ceramic foam filter may be mounted in the filter chamber. The heating unit may include a lid for the filter chamber and/or a drain outlet for the filter chamber.

According to another aspect of the invention there is provided a casting installation for use in a continuous casting process, the installation including a furnace for heating metal to a first liquid metal temperature, a casting machine including a pair of casting rollers and a nozzle arranged to deliver liquid metal into a nip between the casting rollers, such that the metal solidifies as it passes through the nip, a feed line for supplying liquid metal from the furnace to the casting machine, and a heating unit located in the feed line between the furnace and the casting machine, said heating unit being thermostatically controlled and arranged to heat the liquid metal to a second liquid metal temperature; characterised in that the heating unit includes a heating chamber for liquid metal having an inlet and an outlet, the heating chamber being constructed and arranged for a continuous flow of liquid metal through the chamber from the inlet to the outlet, and at least one thermostatically controllable electrical resistance heating element mounted within the heating chamber below the level of the outlet.

The installation may include a degassing unit, the heating unit preferably being located downstream of the degassing unit. The installation may include a filter unit, the heating unit preferably being located downstream of the filter unit. The casting machine may include a headbox, the heating unit preferably being located upstream of the headbox.

The casting installation may include a thermostatic control device for controlling the heating unit. The heating unit may be as defined by any one of the preceding statements of invention.

According to another aspect of the invention there is provided a continuous casting process, the process including the steps of heating a metal in a furnace to a first liquid metal temperature, supplying the liquid metal through a feed line from the furnace to a casting machine that includes a nozzle and a pair of casting rollers, and delivering the liquid metal through the nozzle into a nip between the casting rollers so that the metal solidifies as it passes through the nip; characterised in that the liquid metal is heated to a second liquid metal temperature in a thermostatically controlled heating unit located in the feed line between the furnace and the casting machine; said heating unit including a heating chamber for liquid metal having an inlet and an outlet, the heating chamber being constructed and arranged for a continuous flow of liquid metal through the chamber from the inlet to the outlet, and at least one thermostatically controllable electrical resistance heating element mounted within the heating chamber below the level of the outlet.

The process may include the step of degassing the liquid metal. Advantageously, the liquid metal is heated to the second liquid metal temperature after the degassing step.

The process may include the step of filtering the liquid metal. Advantageously, the liquid metal is heated to the second liquid metal temperature after the filtering step.

Advantageously, the second liquid metal temperature lies in the range 600-800° C., preferably 650-750° C., more preferably 680-720° C.

Advantageously, the liquid metal is heated in the heating unit to produce a temperature rise in the range 0-50° C., preferably 0-20° C., more preferably 0-10° C.

The process may include the step of sensing the temperature of the liquid metal and controlling the heating unit according to the sensed temperature. The temperature of the liquid metal may be sensed at an outlet and/or an inlet of the heating unit.

Advantageously, liquid metal is retained in the heating unit at the end of a casting run, and the retained metal is maintained in a liquid state by heating the metal in the heating unit. Preferably, the depth of the retained metal is sufficient to cover the heating element.

BRIEF DESCRIPTION OF THE DRAWINGS

An embodiment of the invention will now be described, by way of example, with reference to the accompanying drawings, in which.

DETAILED DESCRIPTION OF THE PREFERRED EMBODIMENT

Figure 1:
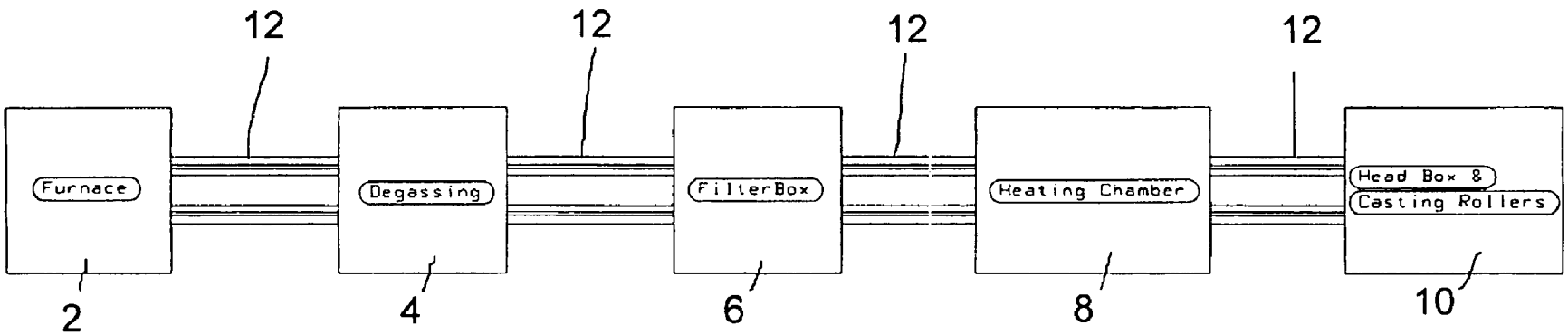
FIG. 1 is a schematic diagram illustrating the main components of an aluminium casting installation.
Figure 2:
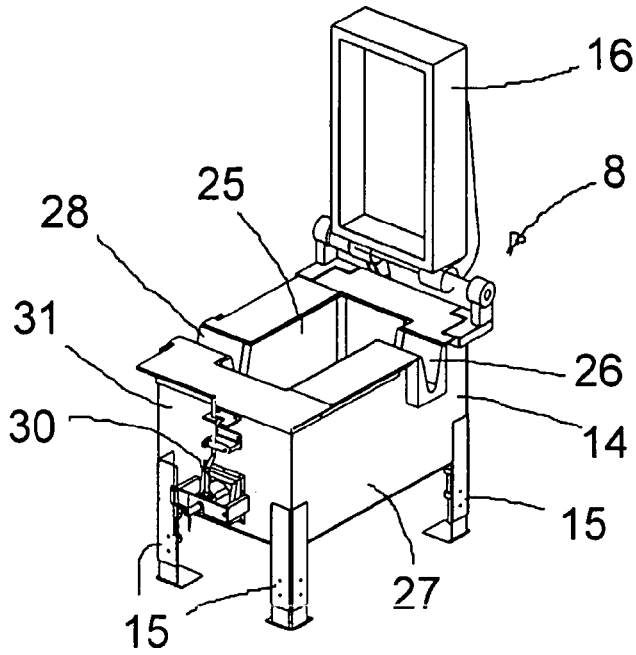
FIG. 2 is an isometric view of a heating unit with the lid open.
Figure 3:
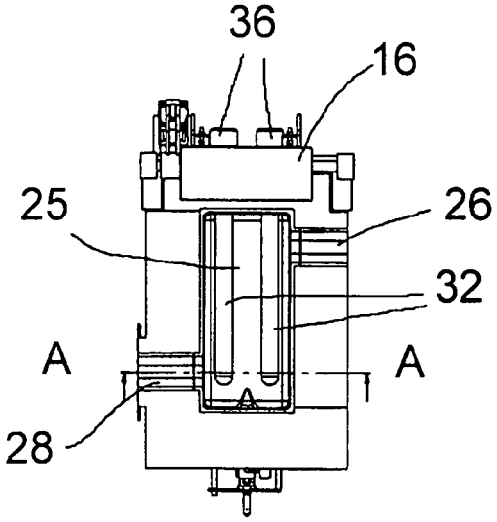
FIG. 3 is a top plan view of the heating unit.
Figure 4:
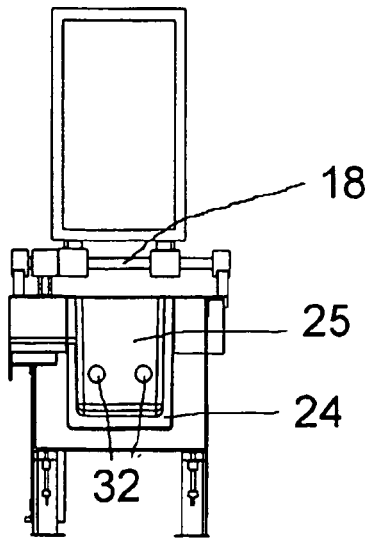
FIG. 4 is a cross-sectional front elevation of the heating unit on line A-A of FIG. 3.
Figure 5:
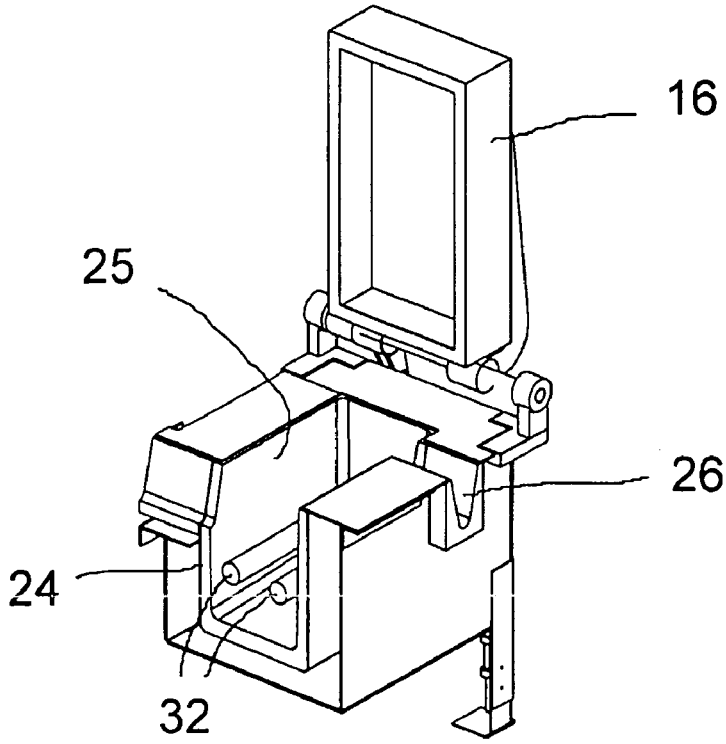
FIG. 5 is an isometric view of a rear part of the heating unit, in cross-section on line A-A.
Figure 6:
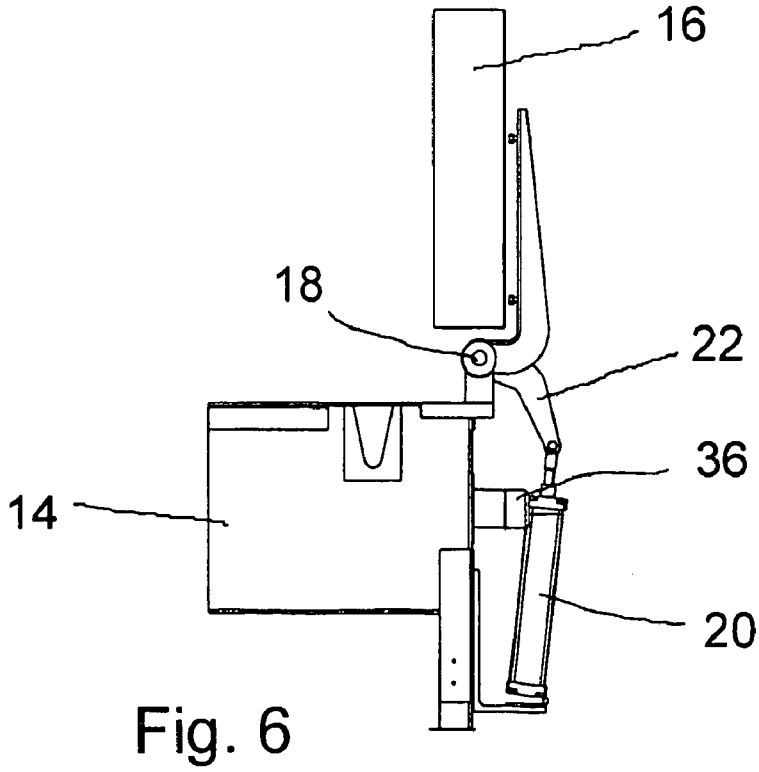
FIG. 6 is an end view of the rear part of the heating unit.
Figure 8:
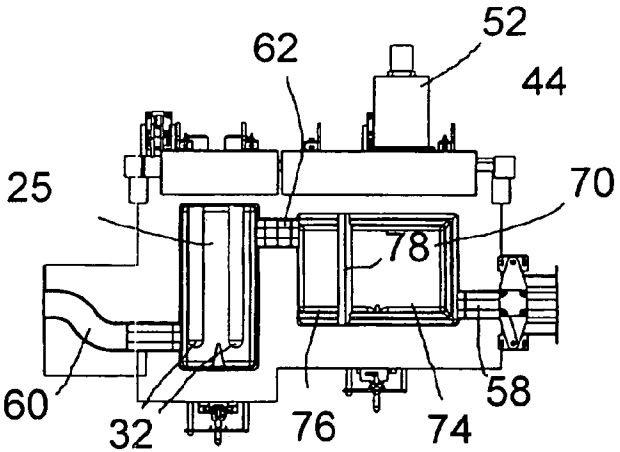
FIG. 8 is a top plan view of the combined unit with the lids open.
Figure 10:
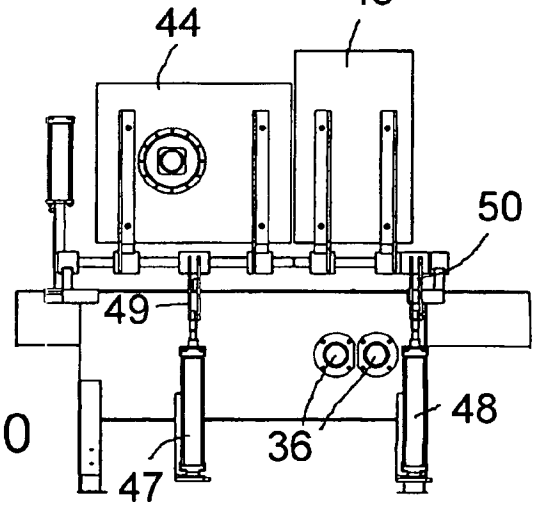
FIG. 10 is a rear elevation of the combined unit with the lids open.
Figure 7:
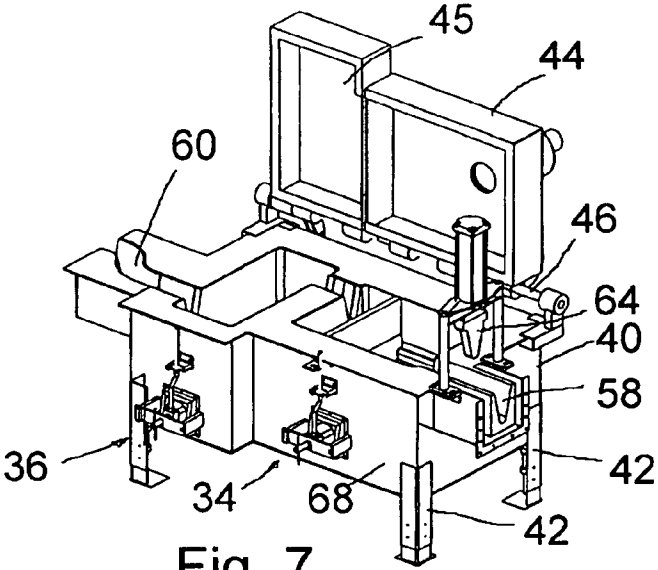
FIG. 7 is an isometric view of a combined filtering and heating unit, incorporating a filter box and a heating chamber, both with their lids open.
Figure 9:
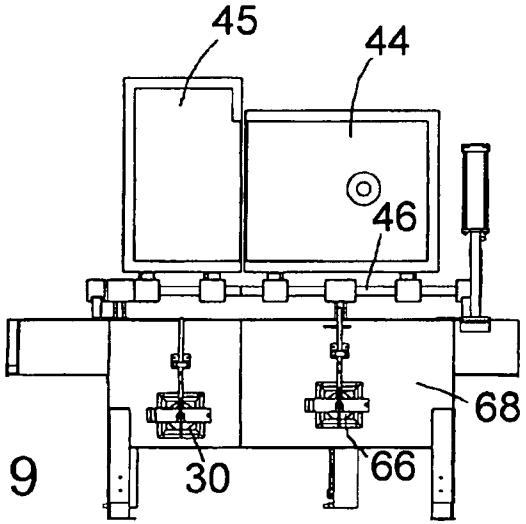
FIG. 9 is a front elevation of the combined unit with the lids open.
Figure 11:
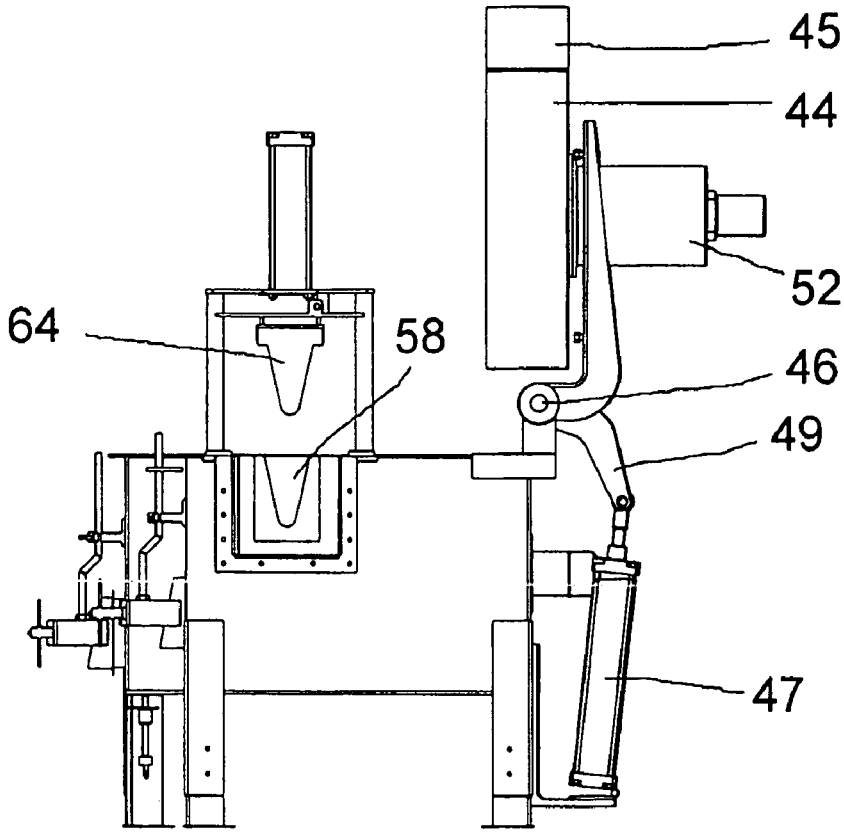
FIG. 11 is an end elevation of the combined unit with the lids open.
Figure 12:
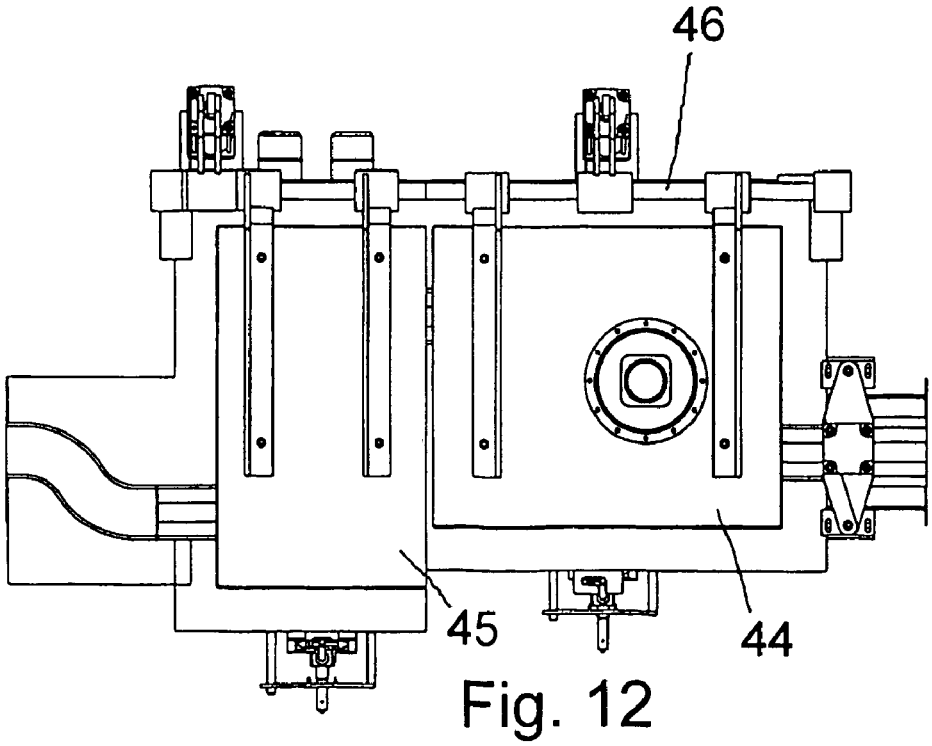
FIG. 12 is a top plan view of the combined unit with the lids closed.
Figure 13:
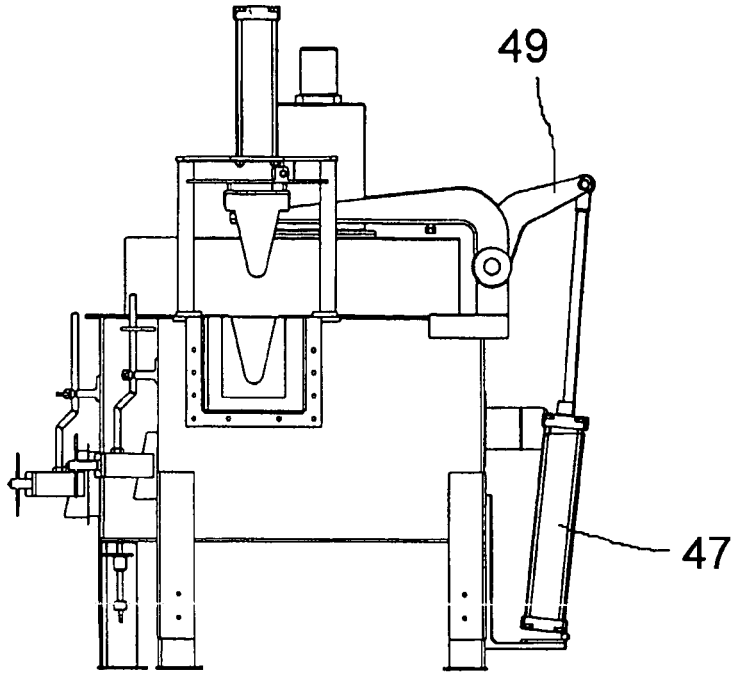
FIG. 13 is an end elevation of the combined unit with the lids closed.
Figure 14:
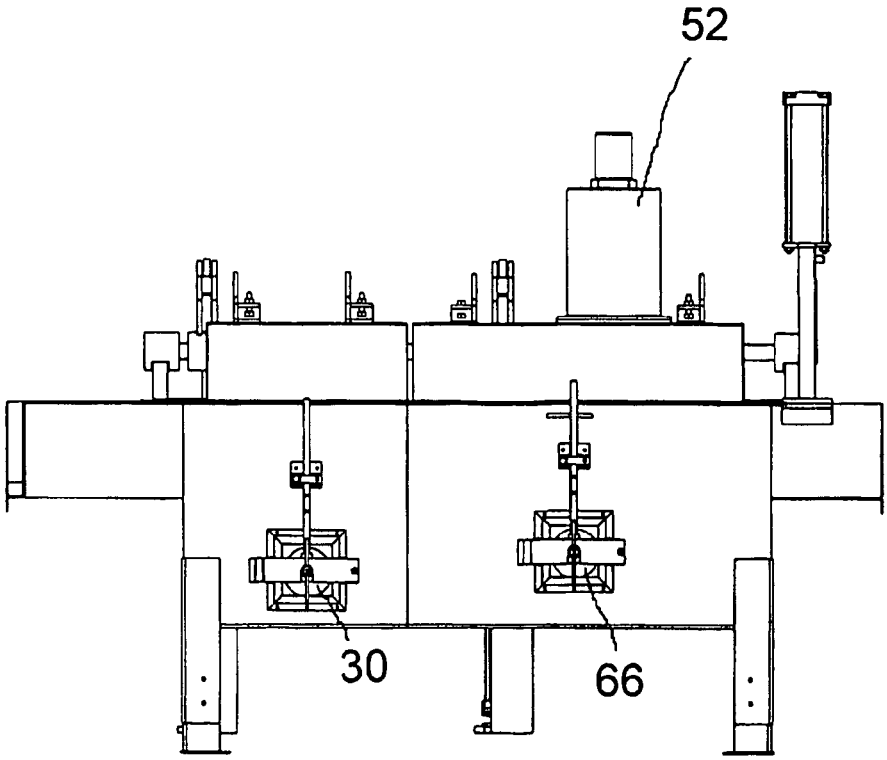
FIG. 14 is a front elevation of the combined unit with the lids closed.
Figure 15:
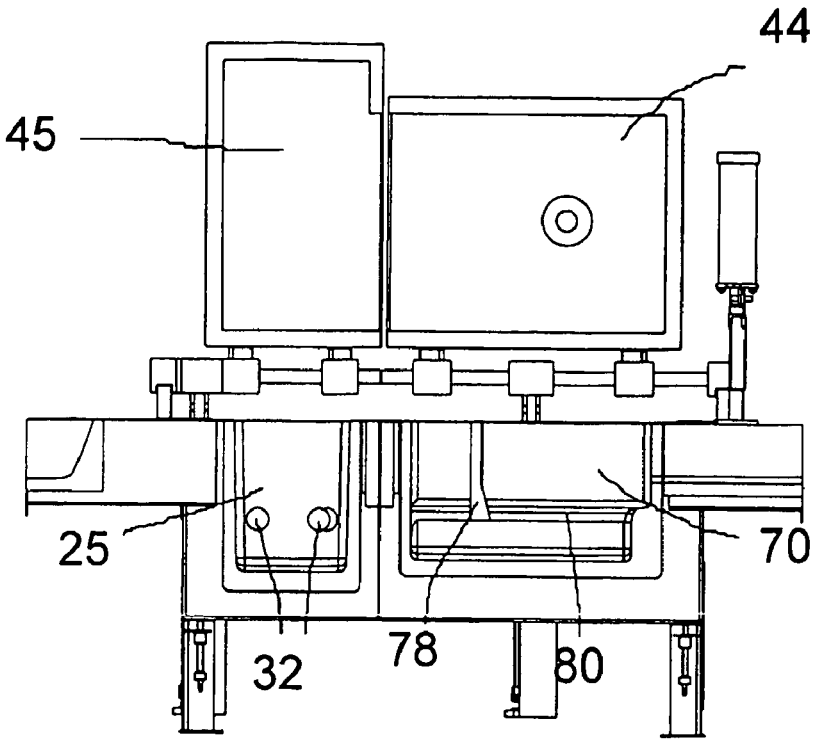
FIG. 15 is a cross-sectional front elevation of the combined unit on line B-B of FIG. 8.
Figure 16:
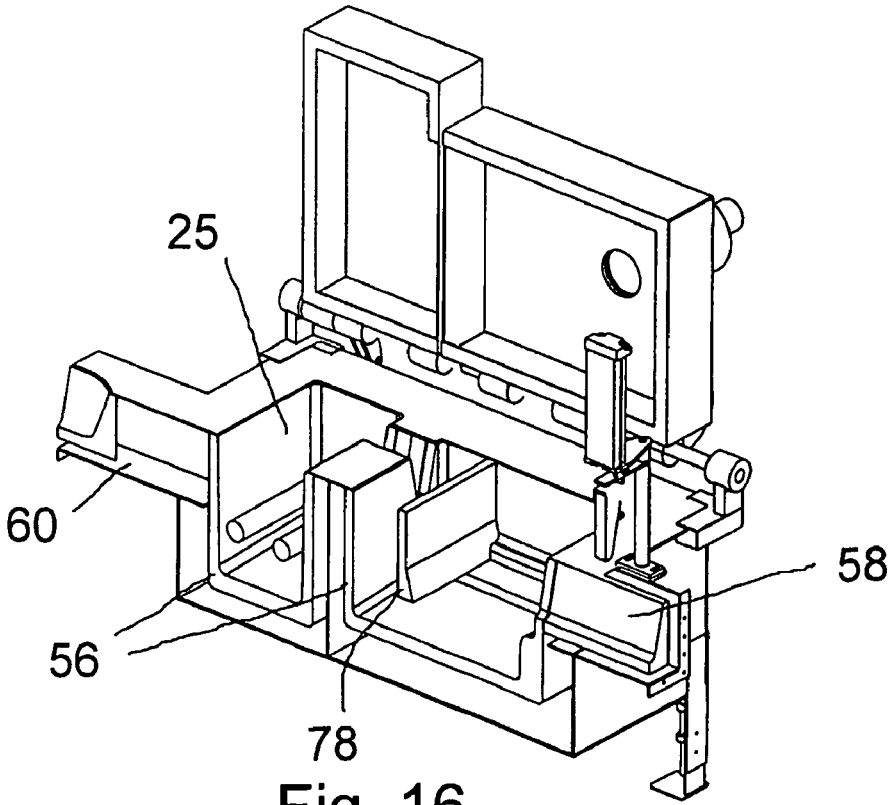
FIG. 16 is a cross-sectional isometric view of the combined unit on line B-B of FIG. 8.

The casting installation shown in FIG. 1 includes a furnace 2, a degassing unit 4, a filter box 6, a heating unit 8, and a casting machine 10. These components of the casting installation are linked together by troughs 12, allowing liquid metal to flow from the furnace 2 through the degassing unit 4, the filter box 6 and the heating unit 8 to the casting machine 10. Apart from the inclusion of the heating unit 8, the installation is conventional.

Two or more furnaces 2 may be provided which can be operated alternately to supply liquid metal substantially continuously to the casting machine 10.

The degassing unit 4 may include one or more rotors for introducing argon gas into the liquid metal to remove dissolved hydrogen. The degassing unit is conventional, a typical example being described in U.S. Pat. No. 4,426,068, the entire content of which is incorporated by reference herein.

The filter box 6 typically contains a ceramic foam filter through which the liquid metal flows, to trap inclusions in the metal and prevent them from reaching the casting machine. The filter box 6 and the ceramic foam filter are conventional, an example of a ceramic foam filter being described in U.S. Pat. No. 3,947,363, the entire content of which is incorporated by reference herein.

The casting machine 10 is designed to provide for the continuous casting of liquid metal and typically includes a head box and a nozzle, through which liquid metal is fed into the nip between two casting rollers. The liquid metal freezes as it passes through the nip, emerging as a semi-finished sheet or rod. An example of a continuous casting machine is described in U.S. Pat. No. 4,153,101, the entire content of which is incorporated herein by reference.

In the embodiment shown in FIG. 1, the heating unit 8 is located between the filter box 6 and the casting machine 10. It should however be understood that whilst this is generally the preferred position for the heating unit, it may be located anywhere between the furnace 2 and the casting machine 10. For example, it may be located between the degassing unit 4 and the filter box 6, or between the furnace 2 and the degassing unit 4. If desired, two or more heating units may be provided at different locations between the furnace and the casting machine.

A first form of the heating unit 8 is shown in FIGS. 2-6. The heating unit 8 includes a steel housing 14, which is supported on legs 15 and has a lid 16 that is pivotally mounted on a hinge bar and is operable by means of a hydraulic actuator 20 that acts on a drive arm 22. The housing 14 supports a refractory liner 24 in the form of an elongate rectangular tub, forming an open-topped chamber 25 having a bottom and a peripheral wall for the liquid metal. An inlet trough 26 is provided in one side wall 27 of the housing in the peripheral wall toward one end of the chamber 25, and an outlet trough 28 is provided on the opposite side 29 of the housing in the peripheral wall, towards the opposite end of the chamber 25, so that liquid metal flowing through the tub flows lengthwise through the chamber 25. The inlet and outlet troughs 26, 28 are V-shaped and extend to slightly less than half the depth of the tub, and are lined with a refractory material. A drain outlet 30 is provided in the end wall 31 of the housing.

Located within the chamber 25 are two electrical resistance heating elements. These elements 32 are contained within refractory sleeves, for example of nitride bonded silicon carbide, and have a power rating of 8 kW each. The heating elements 32 extend parallel to one another along the length of the chamber, and are positioned above the bottom of the chamber, below the lowest point of the outlet trough 28 so that in use they are completely immersed in liquid metal flowing through the chamber. The heating elements 32 are secured within sealed openings in the rear wall 34 of the housing and are provided on their external ends with electrical connectors 36, for connection to a power supply.

Thermocouples (not shown) are provided at the inlet 26 and the outlet 28, to sense the temperature of the liquid metal as it enters and leaves the heating chamber 25. The thermocouples are connected to a control unit (not shown) which controls the power supplied to the electrical heating elements, so as to maintain the temperature of the liquid metal flowing through the outlet 28 at a predetermined value.

In use, liquid metal enters the chamber 25 through inlet 26 and then flows along the chamber before exiting through the outlet 28. The chamber holds approximately 80 litres of liquid metal, which typically has a residency time in the chamber of about 6 minutes. In this time, the two heating elements 32 are capable of raising the temperature of the metal by up to 10° C. The accuracy of the temperature sensors and the control device is such that the output temperature of the metal can be controlled to within an accuracy of ±1° C.

In a typical continuous casting process for aluminium, the ideal casting temperature may be for example 705° C. Previously, to achieve this casting temperature, the liquid metal would have been heated in the furnace to a temperature of about 810° C. to allow for cooling between the furnace and the casting machine by a temperature of about 105° C. However, the temperature in the furnace might typically vary by 5-10° C. and these temperature variations would then propagate down the system, leading to significant variations in the casting temperature and inconsistencies in the grain structure of the cast aluminium.

In the present invention, the thermostatically controlled heating unit may be used to raise the temperature of the liquid metal by up to 10° C. The furnace can therefore be run at a lower temperature, leading to reduced heat losses as the metal moves through the system. Typically, the furnace may be set to heat the metal to a temperature of 780° C. The temperature of the metal may then drop by 800° C. through heat losses as it flows through the system, and then be raised by about 5° C. in the heating unit to produce an casting temperature of 705° C. This temperature can be controlled to an accuracy of ±1° C., producing a more consistent and homogeneous grain structure. The lower furnace temperature also results in reduced hydrogen absorption and therefore a reduced degassing requirement, a reduced energy requirement, and reduced wear on the refractory materials lining the various components of the casting installation.

As mentioned previously, the heating unit is designed so that the heating elements 32 always remain submerged in aluminium in the chamber 25. This reduces wear on the heating elements and prevents a build up of oxides. Any risk of loose oxides contaminating the aluminium is therefore avoided. This is very important, particularly if the heating unit is located in its preferred position just upstream of the casting machine, since in this position it is located downstream of the filter. By preventing a build up of oxides, any need to clean the heating elements is also avoided, which is again very important since the heating elements are very expensive and easily damaged.

The aluminium in the chamber 25 can be maintained in a liquid state indefinitely by supplying power to the heating elements 32. This avoids any need to pre-heat the heating unit prior to a casting run. When a different alloy is to be cast, any metal remaining in the chamber can be quickly flushed out with the new alloy and that portion of the cast metal can be removed for scrap.

Generally, there will be no need to drain the heating unit 8. However, if for any reason it is necessary to drain the chamber 25, this can be achieved easily by opening the drain outlet 30.

A combined filtering and heating unit that includes a filter box 34 and a heating unit 36 is shown in FIGS. 7 to 16. The filter box 34 and the heating unit 36 are arranged in series, so that liquid aluminium flowing through the unit flows first through the filter box 34 and then through the heating unit 36.

The filter box 34 is conventional, being based on an existing design, and the heating unit 36 is substantially identical to the separate heating unit 8 described above and shown in FIGS. 1-6 of the drawings. The heating unit 36 will not therefore be described in full detail, reference being made to the preceding description of the separate heating unit 8 for a full description of the unit. Where appropriate, the same reference numbers have been used as previously to indicate identical parts of the heating units.

The combined filtering and heating unit includes a steel housing 40, which is supported on legs 42 and has two lids 44,45 for the filter box 34 and the beating unit 36 respectively. The lids 44,45 are pivotably mounted on a common hinge bar 46 and are operable by means of hydraulic actuators 47,48 that act on respective drive arms 49,50. A gas/air burner 52 that may be used for preheating the filter box 34 is mounted on the lid 44 of the filter box. The housing 14 supports a refractory liner 56 that forms two tubs for the filter box 34 and the beating unit 36 respectively. An inlet trough 58 that communicates with the filter box 34 is provided in one end wall of the housing, an outlet trough 60 that communicates with the heating unit 36 is provided at the opposite end of the housing, and a transfer trough 62 is provided between the filter box 34 and the heating unit 36 to allow liquid metal to flow from the filter box to the heating unit. A hydraulically actuated flow control valve 64 is mounted above the inlet trough 58 and is operable to control the flow of liquid metal into the unit. Two drain outlets 66,30 are provided in the front side wall 68 of the housing, to allow liquid metal to be drained from the filter box 34 and the heating unit 36 respectively.

The filter box 34 includes an open-topped filter chamber 70, which is divided into upstream and downstream sections 74,76 respectively by a dam 78. The dam extends downwards from the top of the chamber 70 to about two thirds of its depth, so that liquid metal flowing through the chamber 70 from the upstream section 74 to the downstream section 76 has to flow underneath the dam 78. A ledge 80 is provided around the walls of the upstream part of the chamber 70 and the dam 78. This ledge 80 supports a rigid ceramic foam filter matrix (not shown) that extends across the entire surface of the upstream part 74 of the chamber, approximately level with the lower part of the dam 78.

In use, liquid metal enters the upstream part 74 of the filter chamber 70 through the inlet trough 58 and then flows downwards through the filter and underneath the dam 78, before rising up again in the downstream part 76 of the filter chamber. The metal then flows through the transfer trough 62 into the heating unit 36, where it is heated in the heating chamber 25 by the heating elements 32.

Thermocouples (not shown) are provided at the transfer trough 62 and the outlet 60, to sense the temperature of the liquid metal as it enters and leaves the heating chamber 25. The thermocouples are connected to a control unit (not shown) which controls the power supplied to the electrical heaters 32, so as to maintain the temperature of the liquid metal flowing through the outlet 60 at a predetermined value.

Operation of the combined filter and heating unit to control the temperature of the liquid metal is substantially the same as for the separate heating unit described above, and will not therefore be described in detail. It will be noted, however, that the filter box 34 and the heating unit 36 can be drained independently, allowing the ceramic filter in the filter box 34 to be replaced without draining the heating unit 36. Further, the metal in the heating unit can be maintained in a liquid state by supplying power to the heating elements 32, even when the filter box 34 has been drained. The heating elements 32 may therefore be left immersed in liquid metal semi-permanently, preventing oxide build-up and avoiding any need to pre-heat the heating chamber when re-commencing or commencing a new casting operation.

Various modifications of the invention as described herein are possible, some of which will now be described.

Although the preferred position for the heating unit is usually immediately upstream of the casting machine, so that the temperature of the liquid metal at the casting machine can be controlled with the greatest accuracy, the heating unit may be located at any point in the feed line between the furnace and the casting machine. For example, another possible location for the heating unit is immediately upstream of the filter box, this having the advantage that if any impurities are introduced into the liquid metal as it passes through the heating unit (although this is unlikely, owing to the design of the unit), they will be removed by the filter before the metal reaches the casting machine. The heating unit may also be located further upstream, or two or more heating units may be provided at different locations in the feed line.

Instead of mounting one or more heating elements in the heating chamber, the heating elements may be built into the walls and/or base of the chamber, to avoid any possibility of leakage around the sealed joints where the elements pass through the refractory walls of the heating chamber. Other types of heater (e.g. gas burners) may also be provided.

The invention is particularly applicable to the continuous casting of aluminium and aluminium alloys, but may also be used in the continuous casting of other suitable metals.

What is claimed is:

1. A heating unit for use in a continuous casting installation, said heating unit comprising a heating chamber for liquid metal having a bottom and a peripheral wall, an inlet in the peripheral wall and an outlet in the peripheral wall, the heating chamber being constructed and arranged for a continuous flow of liquid metal through the chamber from the inlet to the outlet, and at least one thermostatically controllable electrical resistance heating element mounted within the heating chamber above the bottom and below the level of the outlet, said heating element being constructed and arranged to heat liquid metal flowing through the chamber to a predetermined liquid metal temperature.

2. The heating unit according to claim 1, wherein each said electrical resistance heating element is enclosed within a protective element made of a refractory material.

3. The heating unit according to claim 2, wherein the protective element comprises a sealed protective sleeve.

4. The heating unit according to claim 1, wherein the heating chamber is elongate, and the inlet and the outlet are located towards opposite ends thereof.

5. The heating unit according to claim 4, wherein said at least one heating element is elongate and is mounted lengthways within the heating chamber.

6. The heating unit according to claim 1, further comprising at least one temperature sensor.

7. The heating unit according to claim 6, wherein the temperature sensor is arranged to sense the temperature of liquid metal adjacent the outlet.

8. The heating unit according to claim 1, wherein the heating chamber has a refractory liner.

9. The heating unit according to claim 1, further comprising a lid for the heating chamber.

10. The heating unit according to claim 1, further comprising a drain outlet for the heating chamber.

11. The heating unit according to claim 1, further comprising a filter chamber.

12. The heating unit according to claim 11, further comprising a transfer conduit connecting the filter chamber and the heating chamber.

13. The heating unit according to claim 11, wherein the filter chamber is located upstream of the heating chamber.

14. The heating unit according to claim 11, further comprising a ceramic foam filter mounted in the filter chamber.

15. The heating unit according to claim 11, further comprising a lid for the filter chamber.

16. The heating unit according to claim 11, further comprising a drain outlet for the filter chamber.

17. A casting installation for use in a continuous casting process, the installation comprising a furnace for heating metal to a first liquid metal temperature, a casting machine comprising a pair of casting rollers and a nozzle arranged to deliver liquid metal into a nip between the casting rollers, such that the metal solidifies as it passes through the nip, a feed line for supplying liquid metal from the furnace to the casting machine, and a heating unit located in the feed line between the furnace and the casting machine, said heating unit being thermostatically controlled and arranged to heat the liquid metal to a second liquid metal temperature; wherein the heating unit comprises a heating chamber for liquid metal having an inlet and an outlet, the heating chamber being constructed and arranged for a continuous flow of liquid metal through the chamber from the inlet to the outlet, and at least one thermostatically controllable electrical resistance heating element mounted within the heating chamber below the level of the outlet.

18. The casting installation according to claim 17, further comprising a degassing unit.

19. The casting installation according to claim 18, wherein the heating unit is downstream of the degassing unit.

20. The casting installation according to claim 17, further comprising a filter unit.

21. The casting installation according to claim 20, wherein the heating unit is downstream of the filter unit.

22. The casting installation according to claim 17, wherein the casting machine further comprises a headbox and the heating unit is upstream of the headbox.

23. The casting installation according to claim 17, further comprising a thermostatic control device for controlling the heating unit.

24. The casting installation according to claim 17, wherein the heating unit is constructed and arranged to heat liquid metal flowing through the chamber to a predetermined liquid metal temperature.

25. A continuous casting process, the process comprising the steps of:

heating a metal in a furnace to a first liquid metal temperature, supplying the liquid metal though a feed line from the furnace to a casting machine that comprises a nozzle and a pair of casting rollers, and delivering the liquid metal through the nozzle into a nip between the casting rollers so that the metal solidifies as it passes through the nip; wherein the liquid metal is heated to a second liquid metal temperature in a thermostatically controlled heating unit located in the feed line between the furnace and the casting machine; said heating unit comprising a heating chamber for liquid metal having an inlet and an outlet, the heating chamber being constructed and arranged for a continuous flow of liquid metal through the chamber from the inlet to the outlet, and at least one thermostatically controllable electrical resistance heating element mounted within the heating chamber below the level of the outlet.

26. The process according to claim 25, further comprising the step of degassing the liquid metal.

27. The process according to claim 26, wherein the liquid metal is heated to the second liquid metal temperature after the degassing step.

28. The process according to claim 25, further comprising the step of filtering the liquid metal.

29. The process according to claim 28, wherein the liquid metal is heated to the second liquid metal temperature after the filtering step.

30. The process according to claim 25, in which the second liquid metal temperature lies in the range 600-800° C.

31. The process according to claim 25, in which the liquid metal is heated in the heating unit to produce a temperature rise in the range 0-50° C.

32. The process according to claim 25, further comprising the step of sensing the temperature of the liquid metal and controlling the heating unit according to the sensed temperature.

33. The process according to claim 32, in which the temperature of the liquid metal is sensed at the outlet of the heating unit.

34. The process according to claim 32, in which the temperature of the liquid metal is sensed at the inlet of the heating unit.

35. The process according to claim 25, wherein liquid metal is retained in the heating unit at the end of a casting run, and the retained metal is maintained in a liquid state by heating the metal in the heating unit.

36. The process according to claim 35, wherein the depth of the retained metal is sufficient to cover the at least one heating element.

37. The method of claim 25, wherein the heating element remains submerged in metal retained within the heating chamber after a casting run.

* * * * *